US007748966B2

(12) United States Patent
Vu

(10) Patent No.: US 7,748,966 B2
(45) Date of Patent: Jul. 6, 2010

(54) RADIAL PISTON PUMP FOR SUPPLYING FUEL AT HIGH PRESSURE TO AN INTERNAL COMBUSTION ENGINE

(75) Inventor: Ngoc-Tam Vu, Ludwigsburg (DE)

(73) Assignee: Continental Automotive GmbH, Hannover (DE)

( * ) Notice: Subject to any disclaimer, the term of this patent is extended or adjusted under 35 U.S.C. 154(b) by 90 days.

(21) Appl. No.: 12/295,774

(22) PCT Filed: Apr. 10, 2007

(86) PCT No.: PCT/EP2007/053446

§ 371 (c)(1),
(2), (4) Date: Oct. 2, 2008

(87) PCT Pub. No.: WO2007/116048

PCT Pub. Date: Oct. 18, 2007

(65) Prior Publication Data

US 2009/0272364 A1 Nov. 5, 2009

(30) Foreign Application Priority Data

Apr. 11, 2006 (DE) ..... 10 2006 017 036

(51) Int. Cl.
*F04B 39/00* (2006.01)
*F04B 1/04* (2006.01)

(52) U.S. Cl. ..... 417/454; 417/273; 417/568; 123/446

(58) Field of Classification Search ..... 123/445, 123/446, 447, 495; 417/447, 451, 454, 455, 417/269, 273, 567, 568
See application file for complete search history.

(56) References Cited

U.S. PATENT DOCUMENTS

| | | | | |
|---|---|---|---|---|
| 3,412,931 | A | 11/1968 | Palmer | |
| 3,556,145 | A * | 1/1971 | Sugden, Jr. | 137/596.15 |
| 3,619,087 | A * | 11/1971 | Beeman | 417/360 |
| 3,803,686 | A * | 4/1974 | Phillips | 29/888.02 |
| 5,358,383 | A * | 10/1994 | Eisenbacher et al. | 417/569 |
| 5,839,468 | A * | 11/1998 | Allred | 137/454.4 |
| 6,238,189 | B1 * | 5/2001 | Guentert | 417/273 |
| 6,446,604 | B1 * | 9/2002 | Guentert et al. | 123/456 |
| 6,450,788 | B1 | 9/2002 | Grabert | |
| 6,558,142 | B2 * | 5/2003 | De Matthaeis | 417/562 |
| 6,568,927 | B1 | 5/2003 | Guentert | 417/569 |
| 6,843,641 | B1 * | 1/2005 | Scharfenberg | 417/273 |

(Continued)

FOREIGN PATENT DOCUMENTS

DE 1653446 A1 11/1971

(Continued)

*Primary Examiner*—Thomas N Moulis
(74) *Attorney, Agent, or Firm*—King & Spalding L.L.P.

(57) ABSTRACT

A radial piston pump (1) for supplying fuel at high-pressure to an internal combustion engine has a displacement housing (3) equipped with a compression chamber (4), a reciprocating piston which is arranged in a cylinder chamber (5) of a cylinder (30), a suction valve (10) which is connected to a fuel supply line (8) and a pressure valve (12) which is connected to a fuel outlet line (14). The suction valve (10) and the pressure valve (12) have, respectively, a closing head (16, 16'), a valve seat (18, 18'), a cylinder section (20, 20') and springs (22, 22'). The suction valve (10) and the pressure valve (12) are identical components and the pressure valve (12) is incorporated into the radial piston pump (1) in the direction of flow counter to the suction valve (10).

20 Claims, 1 Drawing Sheet

U.S. PATENT DOCUMENTS

| | | | | |
|---|---|---|---|---|
| 7,118,350 | B2 * | 10/2006 | Graf et al. | 417/206 |
| 7,415,920 | B2 | 8/2008 | Knauth et al. | |
| 7,484,942 | B2 * | 2/2009 | Proust | 417/478 |
| 7,571,713 | B2 * | 8/2009 | De Luca et al. | 123/446 |
| 2004/0076528 | A1 * | 4/2004 | Kolb et al. | 417/244 |
| 2005/0100448 | A1 | 5/2005 | Graf et al. | |
| 2007/0095405 | A1 | 5/2007 | Uwe et al. | |

FOREIGN PATENT DOCUMENTS

| | | | |
|---|---|---|---|
| DE | 2403588 | C2 | 3/1988 |
| DE | 19848040 | A1 | 4/2000 |
| DE | 198 60 672 | A1 | 7/2000 |
| DE | 19860672 | A1 | 7/2000 |
| DE | 10136925 | C1 | 12/2002 |
| DE | 102 28 552 | A1 | 1/2004 |
| DE | 10228552 | A1 | 1/2004 |
| DE | 102 43 148 | A1 | 3/2004 |
| DE | 10243148 | A1 | 3/2004 |
| DE | 103 10 123 | A1 | 9/2004 |
| DE | 10310123 | A1 | 9/2004 |
| DE | 10 2004 028073 | B3 | 8/2005 |
| DE | 102004028073 | B3 | 8/2005 |
| DE | 10228552 | B4 | 2/2006 |
| EP | 1013921 | B1 | 8/2004 |

* cited by examiner

RADIAL PISTON PUMP FOR SUPPLYING FUEL AT HIGH PRESSURE TO AN INTERNAL COMBUSTION ENGINE

CROSS-REFERENCE TO RELATED APPLICATIONS

This application is a U.S. National Stage Application of International Application No. PCT/EP2007/053446 filed Apr. 10, 2007, which designates the United States of America, and claims priority to German Application No. 10 2006 017 036.9 filed Apr. 11, 2006, the contents of which are hereby incorporated by reference in their entirety.

TECHNICAL FIELD

The invention relates to a radial piston pump for supplying fuel at high pressure to an internal combustion engine, comprising a displacement housing equipped with a compression chamber, a reciprocating piston which is arranged in a cylinder chamber of a cylinder, a suction valve which is connected to a fuel supply line and a pressure valve which is connected to a fuel outlet line, with the suction valve and the pressure valve comprising, respectively, a closing head, a valve seat, a cylinder section and springs.

BACKGROUND

A radial piston pump of this type is already known as the prior art, with which the suction valve and the pressure valve are arranged in the displacement housing and in the cylinder respectively and both valves are at right angles to each other (DE 102 28 552). Furthermore, the suction valve and the pressure valve have different designs. A considerable outlay namely in respect of both the specific design of the suction valve and of the pressure valve as well as in respect of the assembly of these two valve units ensues as a result. A similar design also comprises an additional radial piston pump with the aforementioned disadvantages (DE 103 10 123).

Further radial piston pumps which are counted among the prior art are also set up in a cost-intensive fashion with the aforementioned disadvantages (DE 102 43 148, DE 10 2004 028 073).

SUMMARY

A radial piston pump of the type mentioned in the introduction can be created, which is set up in a simpler fashion and can be assembled more quickly and cost-effectively.

According to an embodiment, a radial piston pump for supplying fuel at high pressure to an internal combustion engine, may comprise a displacement housing equipped with a compression chamber, a reciprocating piston which is arranged in a cylinder chamber of a cylinder, a suction valve which is connected to a fuel supply line, and a pressure valve which is connected to a fuel outlet line, wherein the suction valve and the pressure valve each having a closing head, a valve seat, a cylinder section and springs, wherein the suction valve and the pressure valve are identical components and the pressure valve is incorporated into the radial piston pump in the direction of flow counter to the suction valve.

According to a further embodiment, the suction valve and the pressure valve may be arranged axially parallel in the displacement housing, with both valves being connected to one another by way of an intermediate line. According to a further embodiment, the fuel supply line to the suction valve and the fuel outlet line from the pressure valve can be arranged at a distance from and parallel to one another in the displacement housing. According to a further embodiment, the intermediate line can be arranged between the compression chamber and a supply line in the cylinder. According to a further embodiment, the closing head of the suction valve can be arranged coaxially to the axis of the piston. According to a further embodiment, the closing head of the suction valve and of the pressure valve can be embodied in each instance in the form of a conical section and is guided centrally in the valve seat. According to a further embodiment, the valve seat of the suction valve and of the pressure valve may in each instance be arranged in the front region of the displacement housing which faces the cylinder. According to a further embodiment, the radial piston pump may further comprise seals in the front region and in the end region of the respective valve seats of the suction valve and of the pressure valve. According to a further embodiment, an accumulator can be arranged in at least one displacement housing as at least one of a buffer and a high pressure supply reservoir. According to a further embodiment, the fuel outlet lines of several radial piston pump units can be combined by means of an external ring system.

BRIEF DESCRIPTION OF THE DRAWINGS

The invention is described in more detail below with reference to an exemplary embodiment illustrated in the drawing.

The single

DETAILED DESCRIPTION

Figure 1:
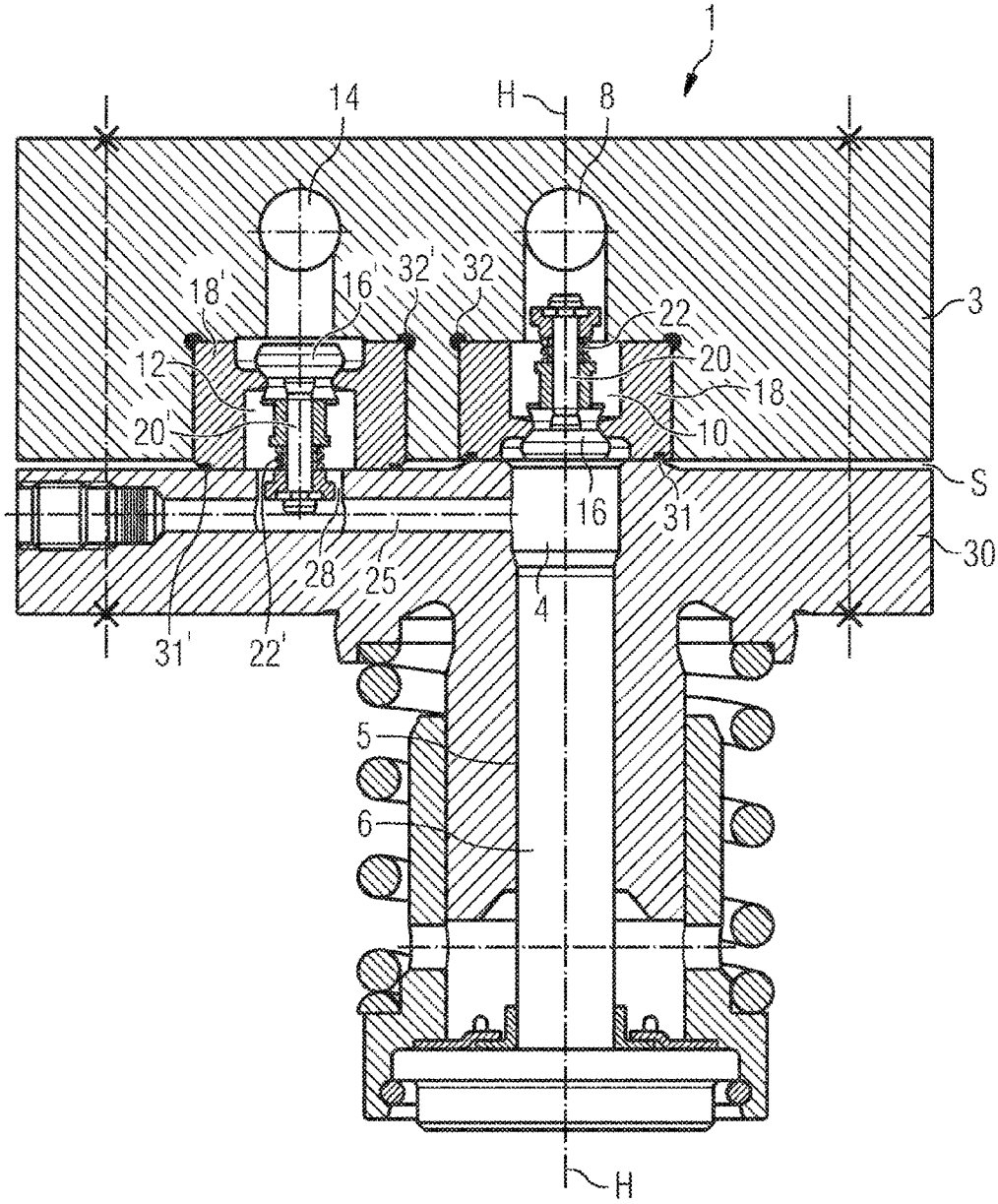
FIG. 1 shows a section through a radial piston pump.

According to various embodiments, the suction valve and the pressure valve are identical components, with the pressure valve being incorporated into the radial piston pump in the direction of flow counter to the suction valve. It may be herewith advantageous that a considerable reduction in the components is possible, a cost-effective construction thus exists. An improved assembly possibility also may result from this construction according to various embodiments since only the pressure valve has to be incorporated into the radial piston pump in the opposite direction to the suction valve.

According to a further embodiment, the suction valve and the pressure valve are arranged axially parallel in the displacement housing and are connected to one another by way of an intermediate line. According to a further embodiment, there is in this way the possibility that the fuel supply line to the suction valve and the fuel outlet line to the pressure valve are arranged at a distance from and parallel to one another in the displacement housing.

According to a further embodiment, the intermediate line can be arranged between the compression chamber and a supply line in the cylinder.

A further simplification of the design and a flow-enhancing solution results from the fact that the closing head of the suction valve is arranged coaxially in respect of the axis of the piston. The closing head of the suction valve and of the pressure valve can as a result be embodied in each instance in the form of a conical section and can be guided centrally in the valve seat. The suction valve is designed in a flow-enhancing fashion by optimizing the dead space volume.

According to a further embodiment, the valve seats of the suction valve and of the pressure valve are arranged in each instance in the front region of the displacement housing which faces the cylinder. Furthermore, seals can be incorporated into the front region and into the end region of the respective valve seats of the suction valve and of the pressure valve, so that with the construction according to various embodiments, no elastomer seals are needed, since metallic seals known per se can be used.

The radial piston pump shown in the drawing is used to supply fuel at high pressure to an internal combustion engine, in particular to a common rail injection system. This radial piston pump 1 has a displacement housing 3 and a cylinder 30 connected thereto. A reciprocating piston 6, which can be driven by an eccentrically embodied drive shaft which is known per se (not shown), is located in a cylinder chamber 5 of the cylinder 30 in order to generate the aforementioned reciprocating motion.

A suction valve 10, which is connected to a fuel supply line 8, is located in the displacement housing 3, as well as a pressure valve 12, which is connected to a fuel outlet line 8, preferably in a common rail injection system.

According to various embodiments, the suction valve 10 and the pressure valve 12 are identical components, with, as shown from the FIGURE, the pressure valve 12 being incorporated into the radial piston pump in the direction of flow counter to the suction valve 10, in the present case in the displacement housing 3.

It is also obvious from the FIGURE that the suction valve 10 and the pressure valve 12 are arranged axially parallel in the displacement housing 3 and are connected to one another by way of an intermediate line 25. This intermediate line 25 is located in the cylinder 30, namely between a compression chamber 4 and a supply line 28 at the pressure valve 14. The compression chamber 4 is located above the reciprocating piston 6 in the cylinder chamber 5.

The suction valve 10 and the pressure valve 12 each have a closing head 16 or, as the case may be, 16', a valve seat 18, 18', a cylinder section 20, 20' and springs 22, 22'. As is apparent from the FIGURE, these individual elements of the components are identical, with the closing head 16, 16' at the valves 10 and 12 being embodied in each instance in the form of a conical section. These closing heads 16, 16' of the suction valve 10 and the pressure valve 12 are guided centrally in the respective valve seat 18, 18'.

The valve seats 18, 18' of the suction valve 10 and of the pressure valve 12 are arranged in recesses in the front region S of the displacement housing 3 which faces the cylinder 30. It can be seen here that the closing head 16 of the suction valve 10 can run coaxially in respect of the axis H-H of the piston 6.

With precise manufacturing, these valve seats 18, 18' can also be used as a seal between the lines 14 and 25 and/or 8 and 25.

Alternatively, it is possible for the valve seats 18, 18' of the suction valve 10 and of the pressure valve 12 to be sealed in each instance on either side by seals 31, 31' or, as the case may be 32, 32' in the front region S and in the end region of the respective valve seats 18, 18' of the suction valve 10 and of the pressure valve 12, with a gap being present between the displacement housing 3 and the cylinder 30, which undergoes a sealing effect by means of the aforementioned seals.

As apparent from the single FIGURE, a pressure accumulator 40 can be arranged in at least one of the three displacement housings 3 of each pump on the high pressure side, said pressure accumulator can if necessary be used in conjunction with the other pressure lines as a buffer and/or as a high-pressure supply reservoir for the purposes of a common rail.

The construction according to various embodiments is designed such that the pump housing (not shown in further detail) is generally arranged below the cylinder 30, said pump housing mostly including three of the illustrated cylinder arrangements in the star-shaped arrangement (i.e. 120 degrees).

The high pressure fuel was previously combined after leaving the pressure valve 12 of each cylinder arrangement and was guided through the aforementioned pump housing. This previously also had to be designed for high pressure. It is now possible for this combination to no longer take place in the pump housing, but instead by means of an external ring system for instance, which no longer runs through the pump housing. This pump housing can thus be designed to be weaker, for instance can be made from aluminum and is thus lighter and cheaper.

The operating mode of the radial piston pump according to various embodiments is such that fuel flows through the fuel supply line 8 via the opened suction valve 10 in the compression chamber 4, undergoes a compression through the piston 6, is routed via the intermediate line 25 and the supply line 28 via the pressure valve 12 opened to counter the effect of the spring 22' to the fuel outlet line 14 and from here to a common rail injection system (not shown in more detail).

The special design of the suction valve 10 and of the pressure valve 12 teamed with its special arrangement in the displacement housing 3 results in a significant simplification in terms of construction and a reduction in assembly costs. A flow-enhancing arrangement with a constructively simple embodiment of the individual components and an improvement in the sealing functions exists.

What is claimed is:

1. A radial piston pump for supplying fuel at high pressure to an internal combustion engine, comprising a displacement housing equipped with a compression chamber, a reciprocating piston which is arranged in a cylinder chamber of a cylinder, a suction valve which is connected to a fuel supply line, and a pressure valve which is connected to a fuel outlet line, wherein the suction valve and the pressure valve each having a closing head, a valve seat, a cylinder section and springs, wherein the suction valve and the pressure valve are identical components and the pressure valve is incorporated into the radial piston pump in the direction of flow counter to the suction valve.

2. The radial piston pump according to claim 1, wherein the suction valve and the pressure valve is arranged axially parallel in the displacement housing, with both valves being connected to one another by way of an intermediate line.

3. The radial piston pump according to claim 2, wherein the fuel supply line to the suction valve and the fuel outlet line from the pressure valve are arranged at a distance from and parallel to one another in the displacement housing.

4. The radial piston pump according to claim 2, wherein the intermediate line is arranged between the compression chamber and a supply line in the cylinder.

5. The radial piston pump according to claim 1,wherein the closing head of the suction valve is arranged coaxially to the axis of the piston.

6. The radial piston pump according to claim 1,wherein the closing head of the suction valve and of the pressure valve is embodied in each instance in the form of a conical section and is guided centrally in the valve seat.

7. The radial piston pump according to claim 1, wherein the valve seat of the suction valve and of the pressure valve are in each instance arranged in the front region of the displacement housing which faces the cylinder.

8. The radial piston pump according to claim 7, comprising seals in the front region and in the end region of the respective valve seats of the suction valve and of the pressure valve.

9. The radial piston pump according to claim 1, wherein an accumulator is arranged in at least one displacement housing as at least one of a buffer and a high pressure supply reservoir.

10. The radial piston pump according to claim 1,wherein the fuel outlet lines of several radial piston pump units are combined by means of an external ring system.

11. A method of supplying fuel at high pressure to an internal combustion engine by a radial piston pump, comprising the steps of:

equipping a displacement housing with a compression chamber, arranging a reciprocating piston in a cylinder chamber of a cylinder, connecting a suction valve to a fuel supply line, and connecting a pressure valve to a fuel outlet line, wherein the suction valve and the pressure valve each having a closing head, a valve seat, a cylinder section and springs, wherein the suction valve and the pressure valve are identical components and the pressure valve is incorporated into the radial piston pump in the direction of flow counter to the suction valve.

12. The method according to claim 11, further comprising the step of arranging the suction valve and the pressure valve axially parallel in the displacement housing, with both valves being connected to one another by way of an intermediate line.

13. The method according to claim 12, further comprising the step of arranging the fuel supply line to the suction valve and the fuel outlet line from the pressure valve at a distance from and parallel to one another in the displacement housing.

14. The method according to claim 12, further comprising the step of arranging the intermediate line between the compression chamber and a supply line in the cylinder.

15. The method according to claim 11, further comprising the step of arranging the closing head of the suction valve coaxially to the axis of the piston.

16. The method according to claim 11, wherein the closing head of the suction valve and of the pressure valve is embodied in each instance in the form of a conical section and is guided centrally in the valve seat.

17. The method according to claim 11, further comprising the step of arranging the valve seat of the suction valve and of the pressure valve in each instance in the front region of the displacement housing which faces the cylinder.

18. The method according to claim 17, further comprising the step of providing seals in the front region and in the end region of the respective valve seats of the suction valve and of the pressure valve.

19. The method according to claim 11, further comprising the step of arranging an accumulator in at least one displacement housing as at least one of a buffer and a high pressure supply reservoir.

20. The method according to claim 11, wherein the fuel outlet lines of several radial piston pump units are combined by means of an external ring system.

* * * * *